US007533785B2

(12) United States Patent
Smith et al.

(10) Patent No.: US 7,533,785 B2
(45) Date of Patent: May 19, 2009

(54) TABLET DISPENSER

(75) Inventors: Kelly A. Smith, East Troy, WI (US); James W. Hammond, North Prairie, WI (US); Cori M. Blomdahl, Muskego, WI (US); John Wisniewski, Wauwatosa, WI (US)

(73) Assignee: SeaQuist Closures Foreign, Inc., Crystal Lake, IL (US)

( * ) Notice: Subject to any disclaimer, the term of this patent is extended or adjusted under 35 U.S.C. 154(b) by 354 days.

(21) Appl. No.: 11/283,429

(22) Filed: Nov. 18, 2005

(65) Prior Publication Data

US 2007/0114239 A1 May 24, 2007

(51) Int. Cl.
*B65G 59/00* (2006.01)

(52) U.S. Cl. ..... 221/263; 221/268; 221/276

(58) Field of Classification Search ..... 221/44, 221/45, 49, 263, 52, 64, 1, 2, 3, 9, 15, 17, 221/21, 65, 66, 92, 134, 151, 185, 175, 186, 221/191, 197, 198, 199, 200, 205, 210, 255, 221/256, 257, 264, 268, 276
See application file for complete search history.

(56) References Cited

U.S. PATENT DOCUMENTS

| | | | | |
|---|---|---|---|---|
| 1,994,063 | A | | 3/1935 | Bruns et al. |
| 2,035,246 | A | | 3/1936 | Rea |
| 2,645,336 | A | | 7/1953 | Waber et al. |
| 2,653,706 | A | | 9/1953 | Aggson |
| 2,669,349 | A | | 2/1954 | Silver |
| 3,301,437 | A | | 1/1967 | Faber |
| 3,310,201 | A | * | 3/1967 | Guarr et al. ..... 221/197 |
| 4,282,990 | A | * | 8/1981 | Miyashita ..... 222/339 |
| 4,354,619 | A | * | 10/1982 | Wippermann et al. ..... 221/263 |
| 4,402,425 | A | | 9/1983 | Schuckmann |
| 4,492,316 | A | | 1/1985 | Emms |
| 4,564,124 | A | | 1/1986 | Burton |
| 4,724,984 | A | | 2/1988 | Wilken et al. |
| 4,784,291 | A | | 11/1988 | Melucci |
| 4,826,043 | A | | 5/1989 | Matz et al. |
| 5,018,644 | A | | 5/1991 | Hackmann et al. |
| 5,174,471 | A | | 12/1992 | Kozlowski et al. |
| 5,351,858 | A | * | 10/1994 | Bar-Yona et al. ..... 221/266 |
| 5,388,722 | A | | 2/1995 | Kageyama |
| 5,480,249 | A | | 1/1996 | Kageyama et al. |
| 5,553,739 | A | * | 9/1996 | Plum et al. ..... 221/196 |
| 5,657,901 | A | | 8/1997 | Farside |
| 5,816,441 | A | | 10/1998 | Farside |

(Continued)

OTHER PUBLICATIONS

Form PCT/ISA/210 (second sheet) International Search Report with mailing date of May 23, 2007 for PCT/US06/43070.

(Continued)

*Primary Examiner*—Gene Crawford
*Assistant Examiner*—Kelvin L Randall, Jr.
(74) *Attorney, Agent, or Firm*—Wood, Phillips, Katz, Clark & Mortimer

(57) ABSTRACT

A dispenser is provided for dispensing tablets. The dispenser generally includes a housing and a compartment. The compartment is pivotable with respect to the housing between a dispensing position and a non-dispensing position. The dispenser may also include a biasing member to bias the compartment to the non-dispensing position and a rib to resist accidental pivoting of the compartment.

11 Claims, 13 Drawing Sheets

U.S. PATENT DOCUMENTS

| | | | | |
|---|---|---|---|---|
| 6,068,126 | A | 5/2000 | DeJonge | |
| 6,206,235 | B1 | 3/2001 | Green | |
| 6,726,058 | B2 | 4/2004 | Giraud | |
| 6,948,634 | B2 | 9/2005 | Evans et al. | |
| 2004/0004083 | A1 * | 1/2004 | Grant | 221/185 |
| 2004/0124204 | A1 | 7/2004 | Giraud | |
| 2004/0169049 | A1 | 9/2004 | Giraud | |
| 2005/0269341 | A1 * | 12/2005 | Maietta et al. | 221/2 |

OTHER PUBLICATIONS

Four photographs on sheet 1 labeled “Smint Package”.
Four photographs on sheet 2 labeled “Smint Package”.
Four photographs on sheet 3 labeled “Smint Package”.
Four photographs on sheet 4 labeled “Trebor 24-7 Package”.
Four photographs on sheet 5 labeled “Trebor 24-7 Package”.
Four photographs on sheet 6 labeled “Trebor Softmints Package”.
Four photographs on sheet 7 labeled “Trebor Softmints Package”.
Four photographs on sheet 8 labeled “Trebor Softmints Package”.

* cited by examiner

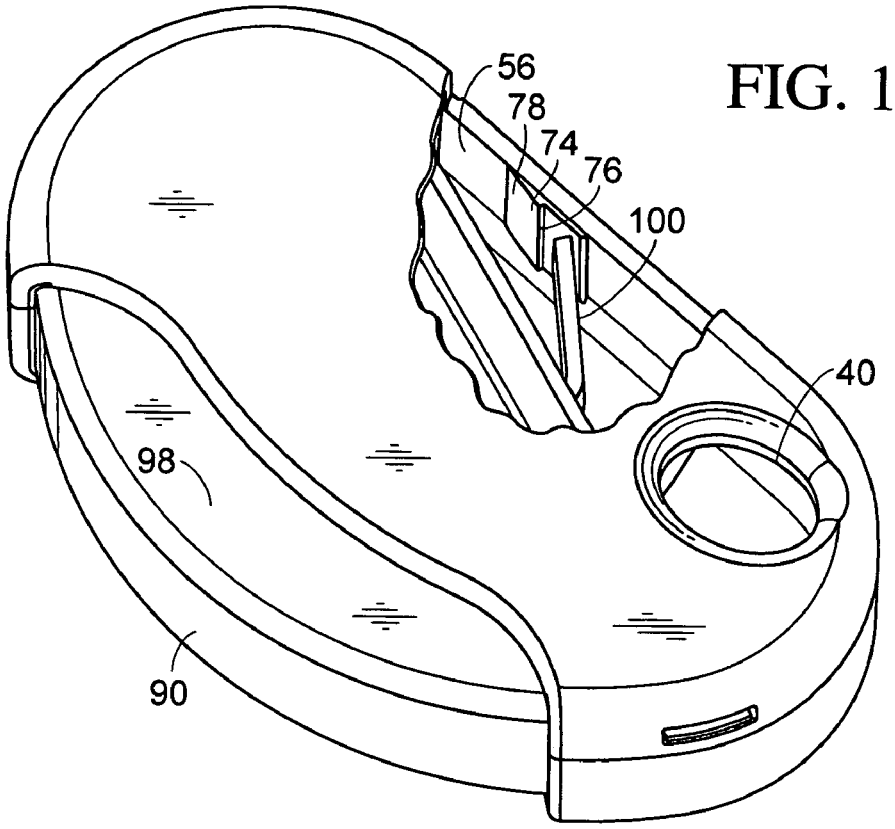
FIG. 16
FIG. 17
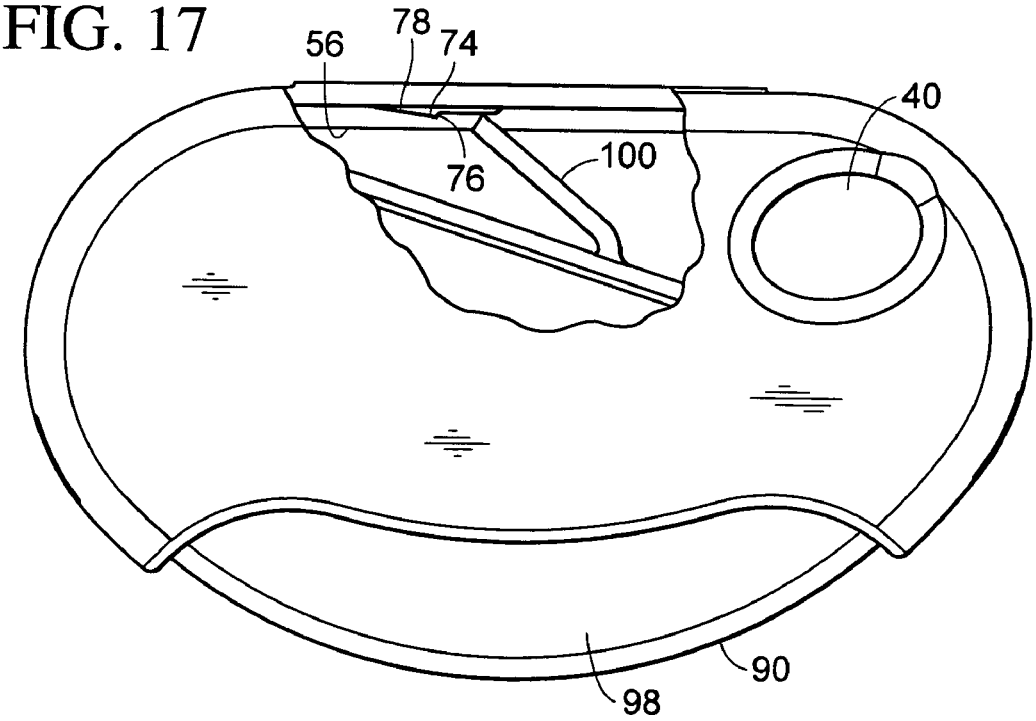

TABLET DISPENSER

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a tablet dispenser. The dispenser of this invention is especially suitable for dispensing small pieces of candy.

BACKGROUND OF THE INVENTION AND TECHNICAL PROBLEMS POSED BY THE PRIOR ART

Designs have been proposed for handheld dispensers which can be activated to dispense a tablet from a supply of tablets stored in the dispenser. Oftentimes, however, the prior art devices require complex parts or manufacturing processes to make the devices. Additionally, expensive materials may be required to manufacture the device.

Tablet dispensers may be suitable to dispense a wide variety of tablets. For example, such tablet dispensers may be used to dispense over the counter medication, vitamins, supplements and the like. Additionally, tablet dispensers may be suitable to dispense candy, chewing gum, breath mints and the like.

Oftentimes, when tablet dispensers are used to dispense the above items, the dispenser is designed to be small enough to fit in the user's pocket or purse for transport.

For some applications, it may be desirable to provide a tablet dispenser that is easily operable by a user with a single hand.

Additionally, it may be desirable to dispense a single tablet at a time.

It would be desirable to provide an improved dispenser that could accommodate tablets which have a variety of sizes.

Such an improved dispenser should also preferably accommodate ease of use.

It would also be beneficial if an improved dispenser could readily accommodate its manufacture from a thermoplastic material. Additionally, it may be beneficial if an improved dispenser could be easily manufactured using simple injection molding techniques.

Further, it would be desirable if such an improved dispenser could accommodate efficient, high-quality, high-speed, large volume manufacturing techniques with a reduced product reject rate to produce products having consistent operating characteristics unit-to-unit with high reliability.

BRIEF SUMMARY OF THE INVENTION

The present invention can be incorporated in a dispenser that may, but need not, include one or more of the above-discussed, desired features.

According to one aspect of the present invention, a dispenser for tablets is provided. The dispenser includes a housing and a compartment. The housing includes a lower portion, an upper portion and a dispensing orifice. The compartment is located at least partially within the housing and includes a storage region and a tablet transport region. The compartment is pivotable about a pivot axis between (1) a dispensing position wherein the tablet transport region is aligned with the dispensing orifice and (2) a non-dispensing position out of alignment with the dispensing orifice.

In another aspect of the present invention, a dispenser for tablets is provided. The dispenser includes a housing and a compartment located at least partially within the housing. The compartment includes a tablet transport platform. The compartment is pivotable about a first axis to move the platform to a dispensing position wherein at least one tablet is discharged from the platform in a direction that is substantially parallel to the first axis.

In yet another aspect of the invention, a dispenser for tablets is provided. The dispenser includes a housing and a compartment that is pivotable about a pivot axis and that is located as least partially within the housing. The compartment includes a storage base and a tablet transport platform. The storage base is for storing at least some of the tablets in a first plane. The tablet transport platform is for supporting at least one tablet for movement in a second plane parallel to the first plane. The storage base is unitary with the transport platform.

In one aspect of the invention, a method is provided for manufacturing a tablet dispenser. The method includes the steps of: molding a housing having an upper portion and a lower portion where the upper portion is pivotably attached to the lower portion by a hinge, molding a compartment for storage of tablets, inserting the compartment within the housing, and pivoting the housing upper portion relative to the housing lower portion to substantially enclose the compartment within the housing.

Numerous advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 16 is an isometric view of a tablet dispenser in a non-dispensing configuration and incorporating the housing of FIG. 15 with a portion of the housing cut-away to reveal a modified form of the compartment disposed in the interior details;

FIG. 17 is a partial cut-away top view of the tablet dispenser of FIG. 16 in a non-dispensing configuration.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

The tablet dispenser of this invention is suitable for use with a variety of tablets, such as candy and medication tablets, as well as other tablets. The size and shape of the tablets will not be described herein in detail, however, those skilled in the art would readily understand how to adapt the tablet dispenser to operate with a variety of different sizes, shapes and weights of tablets. With respect to the illustrated, preferred embodiments of the invention described herein, the tablets, per se, form no part of, and therefore are not intended to limit, the broadest aspects of the present invention. Additionally, the tablet dispenser may be constructed to dispense either a single tablet at a time or a plurality of tablets at a time depending on the size of the tablets and the design of the dispenser.

Figure 1:
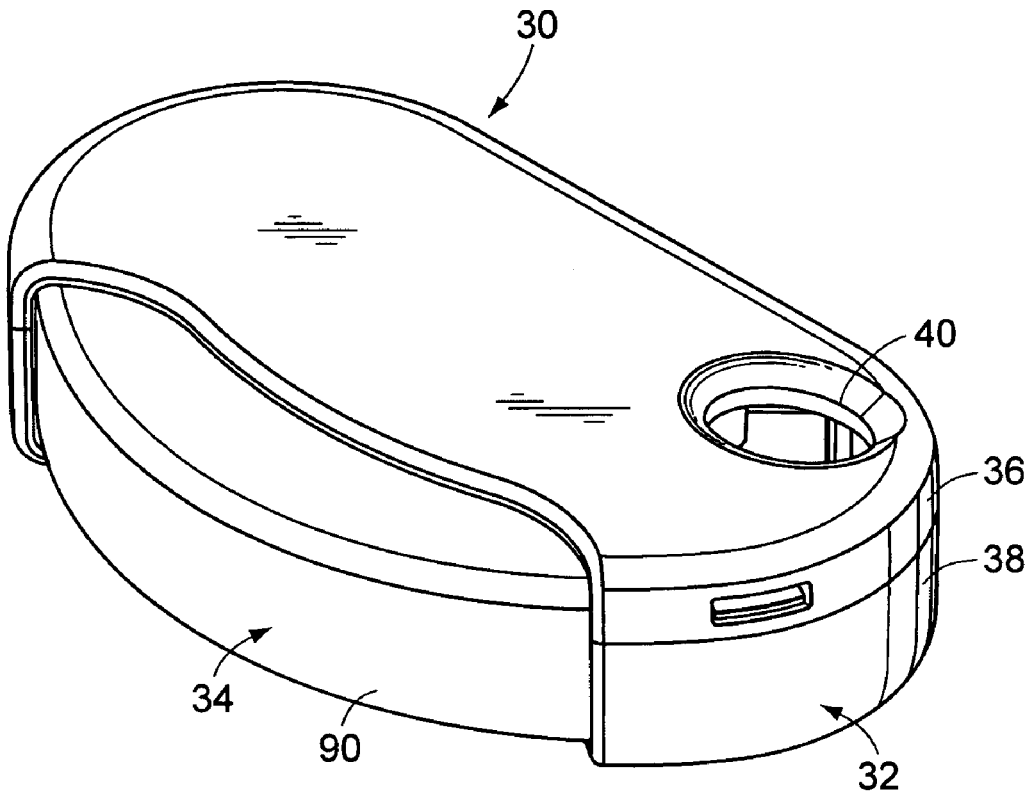
FIG. 1 is an isometric view of a first embodiment of a tablet dispenser.

One presently preferred embodiment of a dispenser for tablets of the present invention is illustrated in FIGS. 1-12 and is designated generally therein by reference number 30 in FIG. 1. Generally, the dispenser 30 includes a housing 32 and a compartment 34. The housing 32 includes an upper portion 36, a lower portion 38 and a dispensing orifice 40. The dispensing orifice 40 is utilized to dispense tablets, generally designated at 42 (FIGS. 1B and 3), from the dispenser 30. As seen in FIG. 1, the compartment 34 is located at least partially within the housing 32.

Figure 1A:
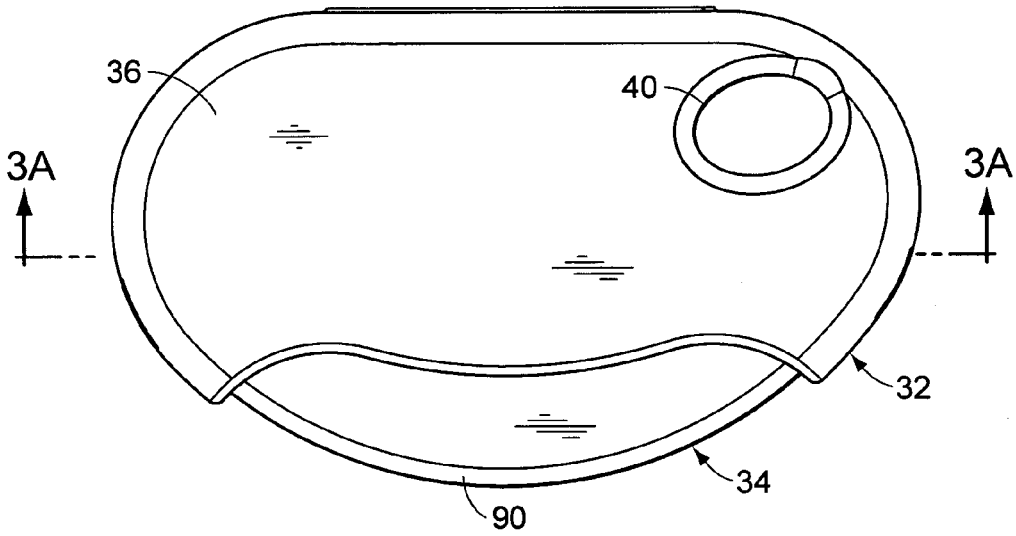
FIG. 1A is a top view of the tablet dispenser of FIG. 1 in a non-dispensing configuration.
Figure 1B:
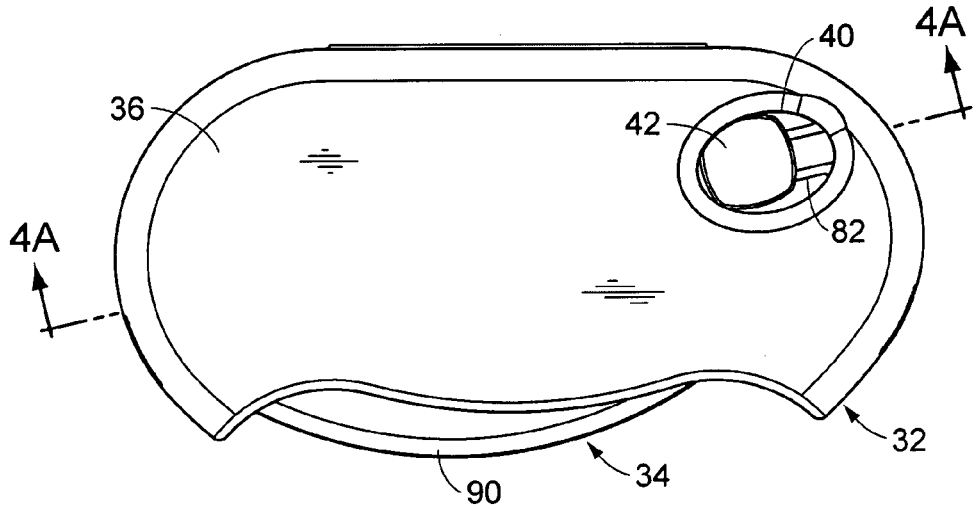
FIG. 1B is a top view of the tablet dispenser of FIG. 1 in a dispensing position.
Figure 3:
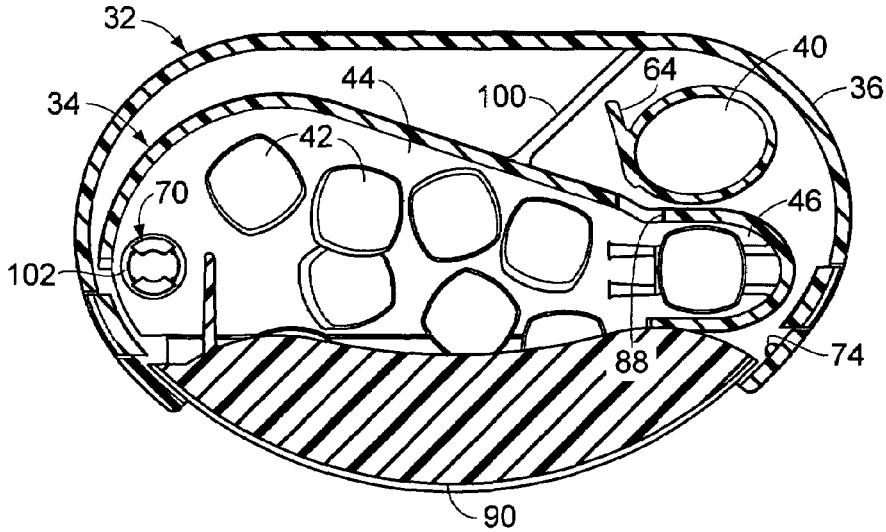
FIG. 3 is a cross-sectional view taken along the plane 3-3 in FIG. 2.
Figure 3A:
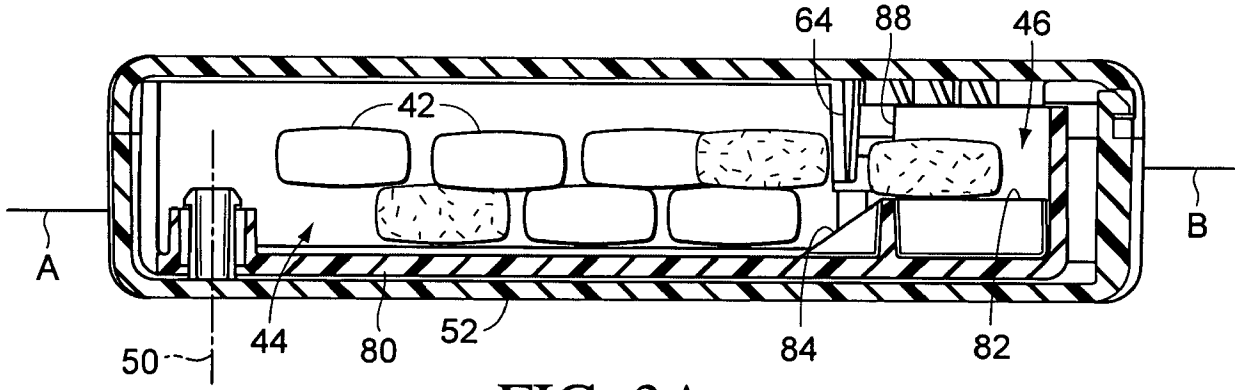
FIG. 3A is an enlarged cross-sectional view taken along the plane 3A-3A in FIG. 1A.
Figure 4A:
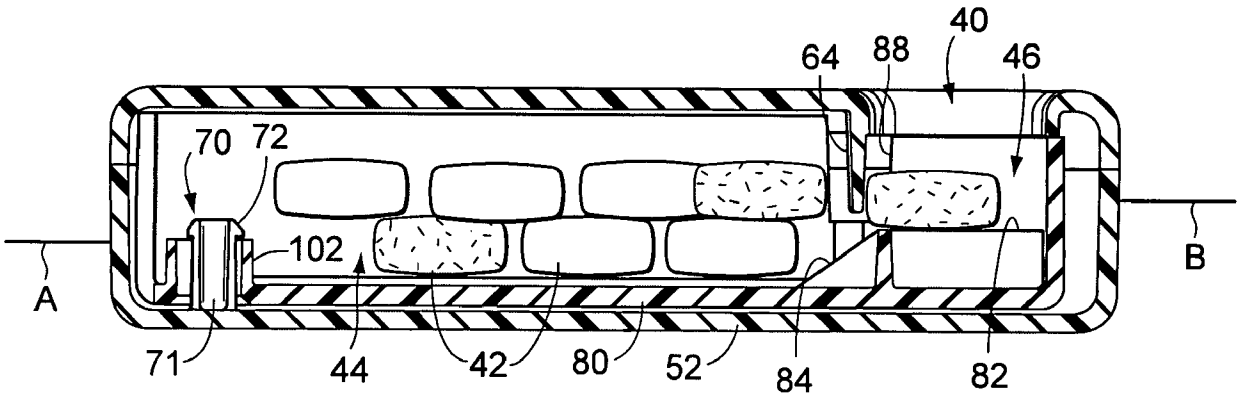
FIG. 4A is an enlarged cross-sectional view taken along the plane 4A-4A in FIG. 1B.
Figure 4:
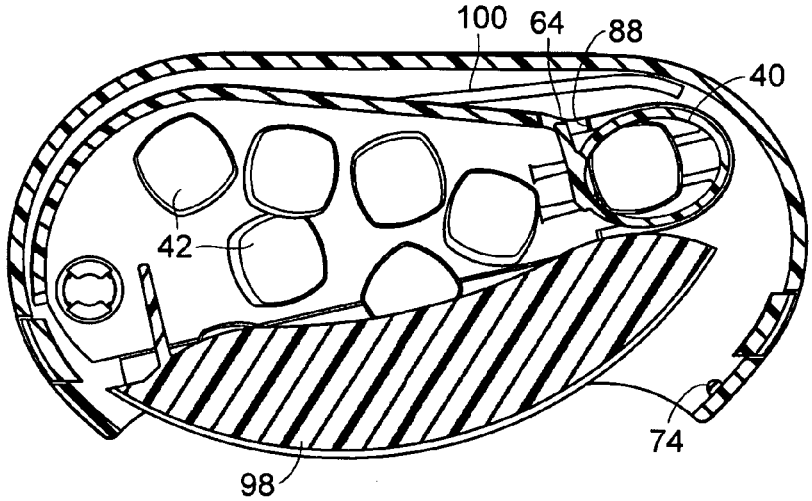
FIG. 4 is a cross-sectional view similar to that of FIG. 3, but of the dispensing position shown in FIG. 1B.

As seen in FIG. 3, the compartment 34 includes a storage region 44 and a tablet transport region 46. The storage region 34 may be utilized for storage of a plurality of tablets 42 to be dispensed while the tablet transport region 46 may be utilized to transport the tablets 42 one at a time, or multiple tablets 42 at a time, to the orifice 40 of the housing 32 when the compartment 34 is moved from a non-dispensing position (FIGS. 1 and 3) to a dispensing position (FIGS. 1B and 4). The compartment 34 is pivotable within the housing 32 about a pivot axis, generally designated by line 50, as seen in FIG. 3A. The compartment 34 is pivotable between a dispensing position wherein the tablet transport region 46 is aligned with the dispensing orifice 40, as illustrated in FIG. B, and a non-dispensing position out of alignment with the dispensing orifice 40, as illustrated in FIG. 1A.

Figure 5:
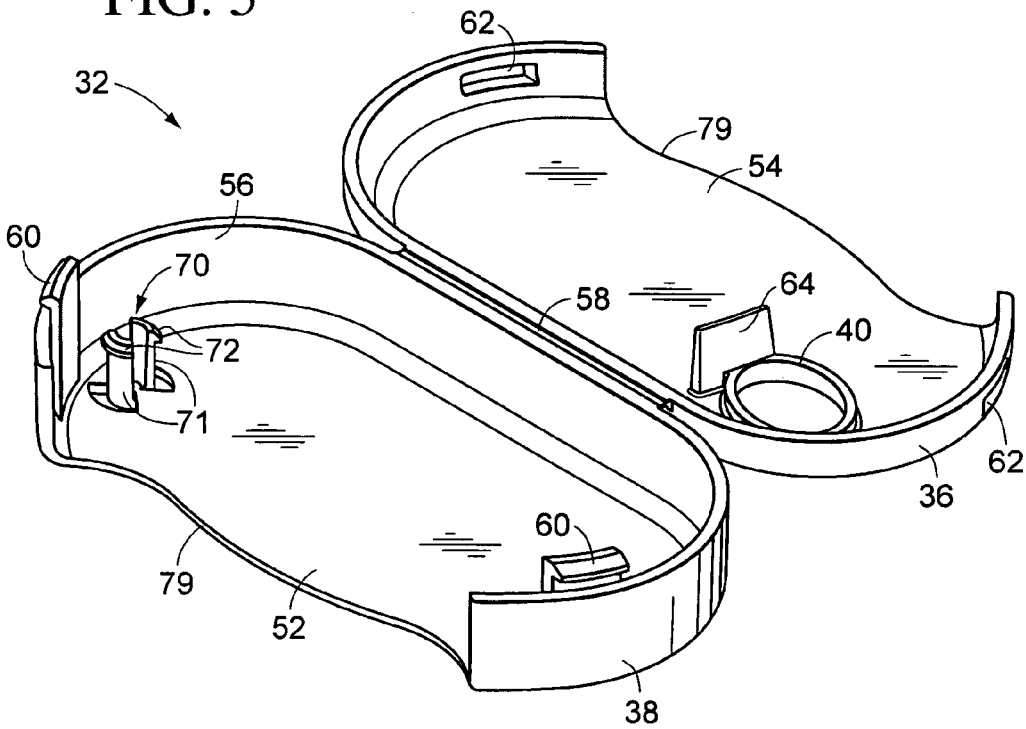
FIG. 5 is an isometric view of a first embodiment of a housing for a tablet dispenser in an initial, as-molded, open configuration prior to being closed.

The structure of the dispenser 30 will now be discussed in more detail. Referring to FIG. 5, the housing 32 is shown as it is initially molded in an open configuration prior to the compartment 34 being mounted in the housing 32 and prior to the housing 32 being closed around the compartment 34. The housing 32 includes a floor 52, a ceiling 54 and a sidewall 56. As seen in FIG. 5, the upper portion 36 may be attached to the lower portion 38 by a hinge 58 or other suitable structure. In one form, the hinge 58 is a film hinge that is generally flexible and strong enough to withstand opening and closing of the housing 32. However, it should be understood that the housing 32 may also be constructed of multiple pieces without a hinge. Additionally, the structure of the hinge 58 may be adjusted as known by those skilled in the art.

The hinge 58 permits the upper portion 36 and/or lower portion 38 to pivot relative to the other portion so that the housing 32 may be configured in a generally closed position, as illustrated in FIG. 1. To retain the housing 32 in the closed position, the housing 32 includes snap fit engaging members 60 and receiving ports 62. To maintain the housing 32 in the closed position, the snap fit engaging members 60 engage the receiving ports 62.

Further, the housing 32 includes a blocking tab 64 to prevent more than one tablets 42 from entering the tablet transport region 46 of the compartment 34. Alternatively, depending on the size of the tablets 42 and the design of the dispenser 30, the blocking tab 64 may allow multiple tablets 42 to enter the tablet transport region 46 while preventing additional tablets 42 from entering. With the housing 32 closed about the compartment 34, the blocking tab 64 will block tablets 42 in the storage region 44 from entering the tablet transport region 46 when the compartment 34 is in the dispensing position. While the blocking tab 64 is illustrated as extending from the housing upper portion 36, it should also be understood that the blocking tab may also be located on, and extend from, the lower portion 38. Alternatively, the blocking tab 64 may be omitted, if desired.

The housing 32 also includes a pivot protrusion, or simply protrusion 70 (FIG. 5). This protrusion 70 may take a variety of forms, but is illustrated in FIG. 5 as being defined by two partially cylindrical segments 71. The protrusion 70 defines the pivot axis 50 which the compartment 34 pivots about between the dispensing and non-dispensing positions. Each segment 71 of the protrusion 70 shown in FIG. 5 includes a flange 72 for retaining the compartment 34 about the protrusion.

Additionally, the housing 32 includes a rib 74 (FIGS. 3 and 11) which function to increase the actuation resistence as described in detail hereinafter. The rib 74 may also take a variety of forms and may be located in a variety of positions on the dispenser 30. In the embodiment shown in FIGS. 1-12, the rib 74 is a protrusion extending from the sidewall 56 of the housing 32. In this embodiment, the rib 74 has a rounded shape.

Figure 13:
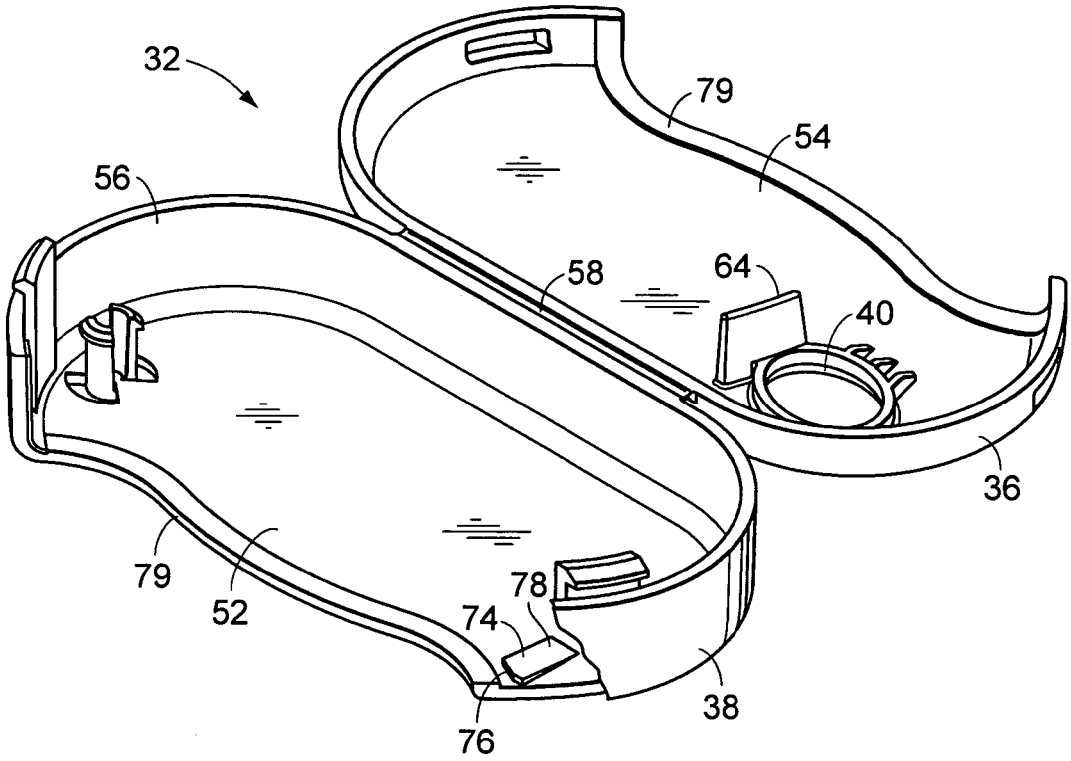
FIG. 13 is an isometric view of a second embodiment of the housing in the initial, as-molded, open configuration prior to being closed.
Figure 14:
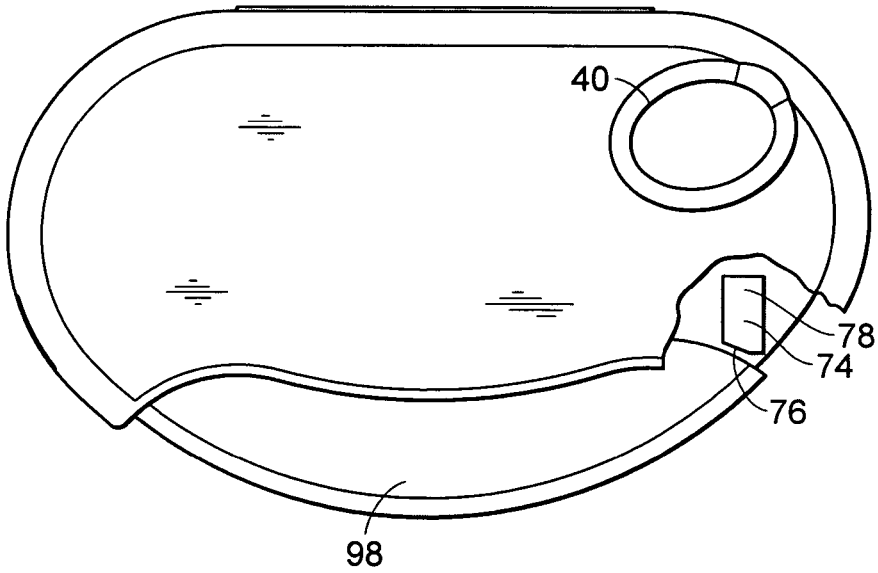
FIG. 14 is a partial cut-away, top view of a tablet dispenser incorporating the second embodiment of the housing of FIG. 13 and the first embodiment of the compartment illustrated in FIGS. 6-9.

The rib 74 may also take the form illustrated in the alternate embodiment shown in FIGS. 13-14. In this form, the rib 74 is located on the floor 52 of the housing 32. Additionally, the rib 74 has more of a ramp-like shape where a front side 76 extends approximately perpendicularly from the floor 52 of the housing, while a back side 78 of the rib 74 extends at a more gradual angle relative to the floor.

Figure 15:
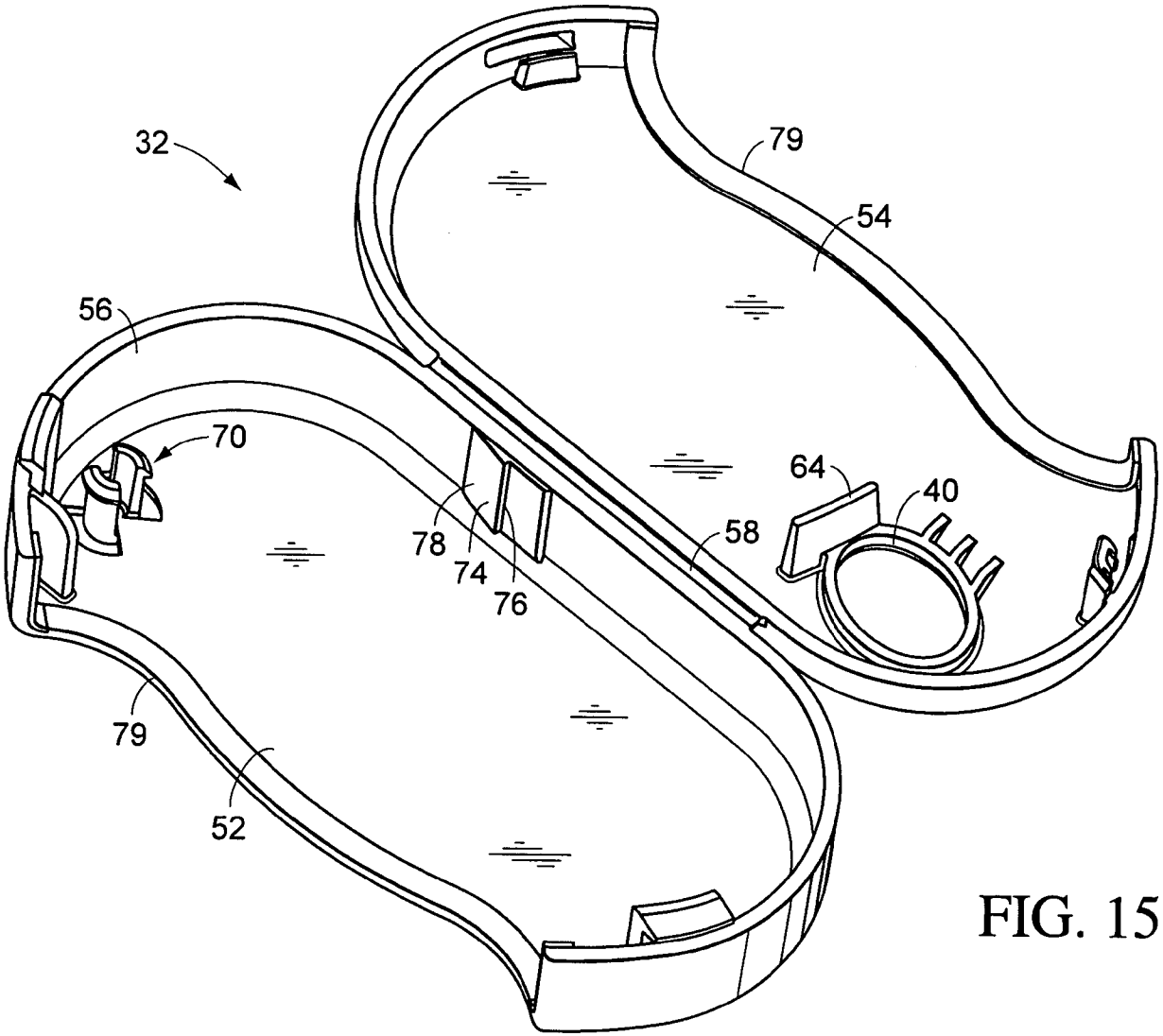
FIG. 15 is an isometric view of a third embodiment of the housing in the initial, as-molded, open configuration prior to being closed.

In yet another embodiment, illustrated in FIGS. 15-17, the rib 74 is located on the sidewall 56 of the housing adjacent the hinge 58. This rib 74 is similar in structure to that described above with reference for FIGS. 13-14. The purpose and detailed operation of these ribs 74 is explained below in regards to the operation of the dispenser 30.

The housing 32 is shown in the figures as having a generally oval shape, as viewed from above. However, it should be understood that the housing 32 may take any other suitable form as understood by those skilled in the art, such as a square, oval, sphere and the like. Additionally, as seen in the figures, the housing 32 generally has a concave, recessed edge or cut-out portion 79 in each of the floor 52 and ceiling 54. While the embodiments shown in the figures include the cut-out portions 79, it should be understood that the housing 32 need not have such a recessed edge or cut-out portion 79. Instead, either or both the floor 52 and ceiling 54 of the housing 32 may have a generally convex or straight edge in lieu of the concave, recessed edge or cut-out portion 79.

The compartment 34 is shown in detail apart from the housing 32 in FIGS. 6-9. As previously described, the compartment 34 is divided into at least two regions, the storage region 44 and the tablet dispensing region 46. The compartment 34 generally includes a base 80, which, when the compartment 34 is placed within the closed housing 32, is disposed above, and parallel to, the floor 52 of the housing 32. As seen in FIG. 4A, the tablets 42 are stored in the storage region 44 with at least some of the tablets 42 lying on or along a plane A and are supported by the base 80.

Figure 7:
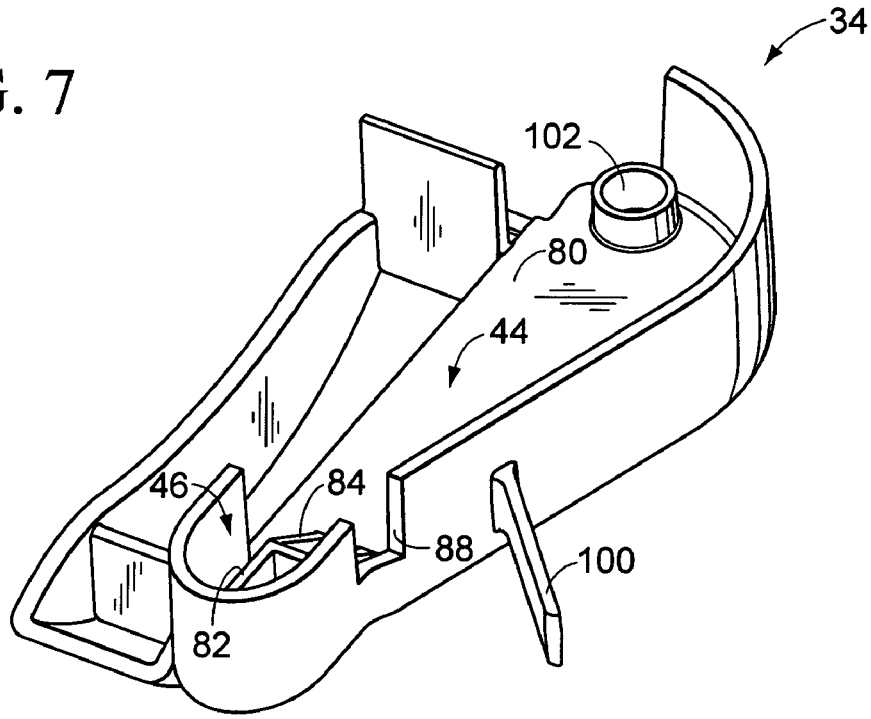
FIG. 7 is an alternative isometric view of the compartment of FIG. 6.

Further, the compartment 34 includes additional structure in the tablet transport region 46. Specifically, as can be seen in FIGS. 3A and 7, the tablet transport region 46 includes a tablet transport platform 82 and a ramp 84 extending from the storage compartment 44 to the tablet transport platform 82. The tablets 42 can slide along the ramp 84, one at a time or multiple tablets 42 at a time, to the tablet transport platform 82 to ultimately be dispensed from the dispenser 30. The tablet transport platform 82 is preferably designed to accept only one tablet 42 at a time, as understood by those skilled in the art. However, the tablet transport platform 82 may also be designed to accept multiple tablets 42 at a time. The number of tablets 42 to be dispensed with a single actuation of the dispenser 30 depends on the size of the tablets 42 and the size of the platform 82 beyond the blocking tab 64.

Figure 12:
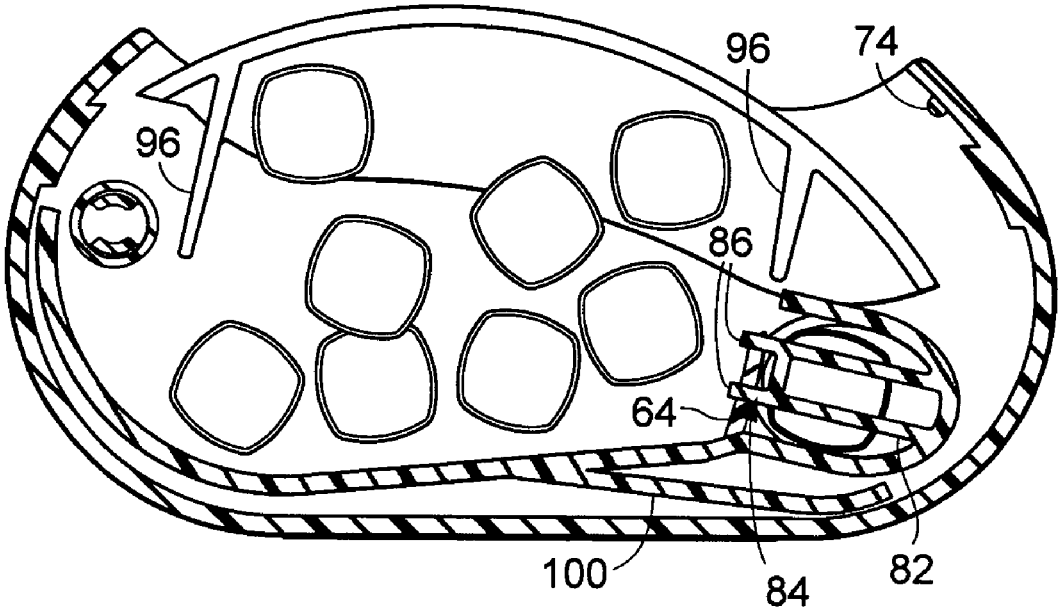
FIG. 12 is a view similar to FIG. 11, but FIG. 12 shows the dispenser in the dispensing position.

As seen in FIG. 12, which is a partial cut-away view taken from the bottom of the dispenser 30, the preferred form of the ramp 84 may include two legs 86. However, it should also be understood that the ramp 84 may take the form of a solid ramp 84 or other structure suitable as understood by those skilled in the art. Similarly, the tablet transport platform 82 may take the form of an extension of the legs 86. However, the tablet transport platform 82 may also take other forms, such as a solid platform, as understood by those skilled in the art.

The compartment 34 also includes a slot 88 (FIGS. 3A, 4A, and 6) located adjacent the tablet transport region 46. The slot 88 is located on the compartment 34 so as to accommodate the blocking tab 64 when the compartment 34 is installed within the housing 32 and actuated. Specifically, the slot 88 permits the compartment 34 to pivot to the dispensing position (FIG. 4) by allowing the blocking tab 64 to enter the compartment 34 and prevent additional tablets 42 from entering the single tablet transport platform 82. However, this slot 98 may be omitted if the blocking tab 64 is omitted.

Figure 6:
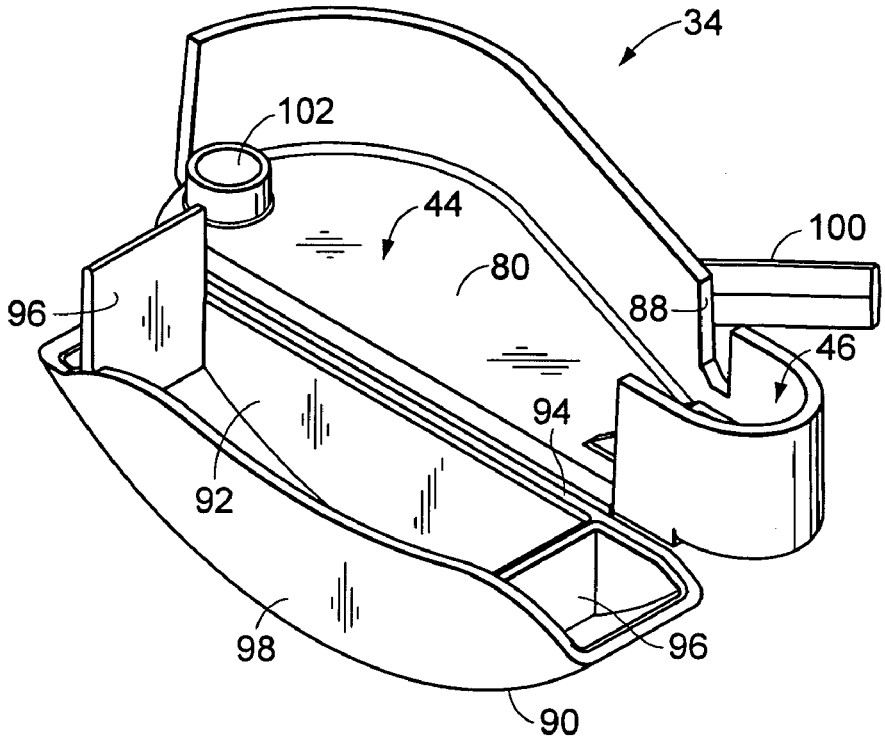
FIG. 6 is an isometric view of a first embodiment of a compartment for a tablet dispenser shown in an as-molded configuration.
Figure 8:
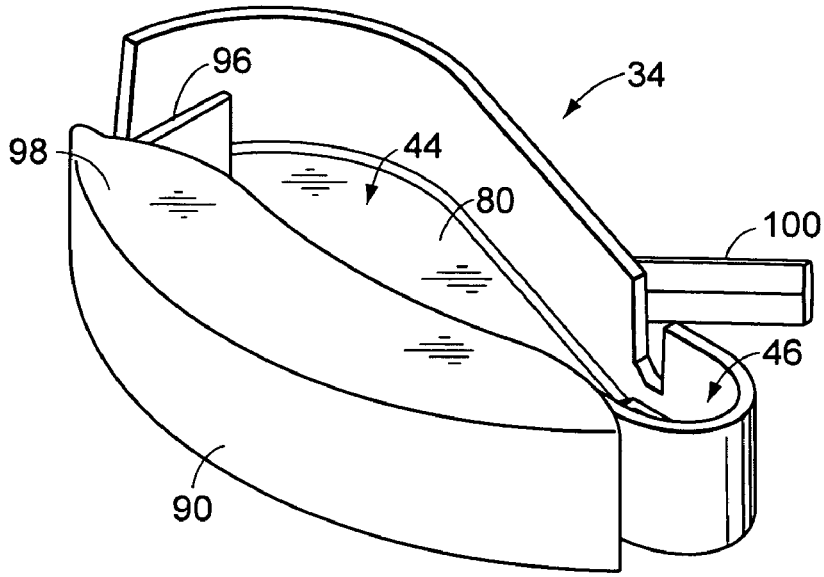
FIG. 8 is an isometric view of the compartment of FIG. 6 after a trigger portion of the compartment has been rotated from the initial, as-molded position to the functional position.
Figure 9:
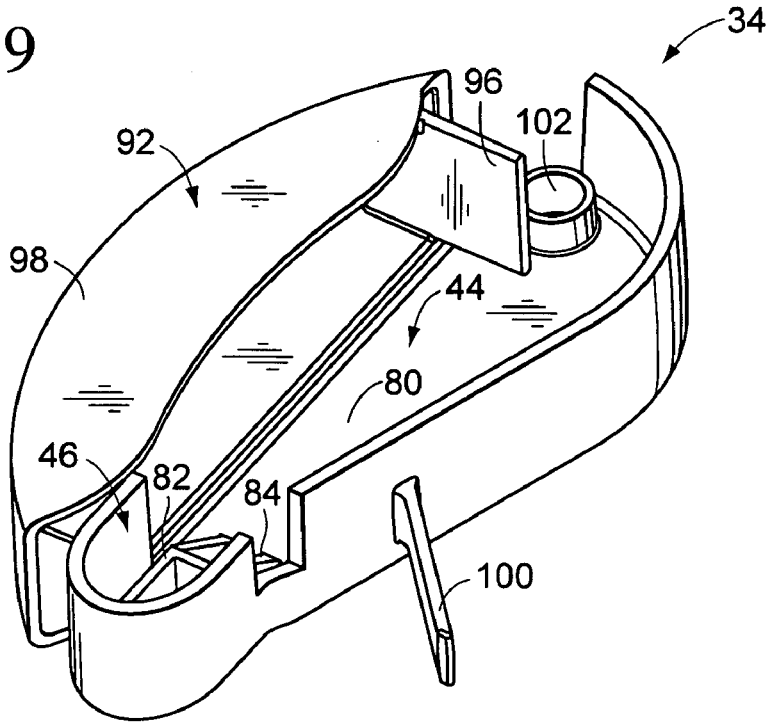
FIG. 9 is an isometric view of the compartment of FIG. 8 in an alternative orientation.

The compartment 34 also includes a trigger 90, which may be operated by a user to cause the compartment 34 to pivot as well as perform other functions which will be understood by those skilled in the art. As seen in FIG. 6, the trigger 90 is located on a portion 92 of the compartment 34. The portion 92 may also include additional structure such as a hinge 94 and reinforcing struts 96. The hinge 94 permits the portion 92 to pivot with respect to the remainder of the compartment 34. The reinforcing struts 96 perform a variety of functions, such as reinforcing the portion 92 as well as preventing the portion 92 from pivoting beyond a desired, operative orientation, as illustrated in FIGS. 8-9. The purpose of allowing the portion 92 to pivot will become readily apparent from the description of the manufacturing process of the dispenser 30 below.

The portion 92 may also include a covering portion 98 (FIG. 8). The covering portion 98 may be included or omitted depending upon the design of the housing 32. The covering portion 98 covers some of the compartment 34, but need not cover a significant part of the compartment 34. The covering portion 98 may also add rigidity to the trigger 90 and the portion 92. Therefore, at least some of the base 80 is not covered or occluded by the covering portion 98. However, depending upon the design of the housing 32, the covering portion 98 may be omitted entirely.

Additionally, the compartment 34 includes a biasing member 100. The biasing member 100 may take a variety of forms, such as a spring or other suitable structure as understood by those skilled in the art. The biasing member 100 is located on the compartment 34, and when the compartment 34 is installed in the housing 32, the biasing member 100 engages the sidewall 56 of the housing 32 to provide a biasing force. Alternatively, the biasing member 100 may instead be located on the housing sidewall 56 and engage the compartment 34.

The compartment 34 also includes a protrusion opening 102 to receive the protrusion 70 of the housing 32. The protrusion opening 102 may be sized to generally fit about the protrusion 70. However, the protrusion opening 102 may be sized such that it is slightly smaller than the protrusion 70 and that it is retained by the flanged segments 72. Alternatively, the protrusion 70 may be located on the compartment 34 and the protrusion opening 102 may be located on the housing 32.

The compartment 34 is shown in the figures as having a generally kidney-like shape, as viewed from above. However, it should be understood that the housing 32 may take any other suitable form as understood by those skilled in the art, such as a square, oval, sphere and the like.

The manufacture and assembly of the dispenser 30 will now be discussed in detail. The general manufacturing process of the housing 32 and the compartment 34 may be performed using injection molding or other similar processes understood by those skilled in the art for manufacturing thermoplastics. Each of the housing 32 and the compartment 34 may be manufactured in a single step or multiple steps or pieces. For example, the embodiment of the housing 32 shown in FIG. 5 may be manufactured using a relatively simple injection molding process in which the housing 32 is molded as a single, unitary structure in an initial, open configuration wherein the hinge 58 permits the housing to be subsequently placed in a closed configuration after the compartment 34 is installed.

Similarly, the compartment 34 may be manufactured using a relatively simple injection molding process requiring no side action molds as the portion 92 is connected by a hinge 94 to the remainder of the compartment 34. However, the compartment 34 may alternatively be initially manufactured in the operative configuration shown in FIGS. 8 and 9, but without the hinge 94, whereby the entire base 80 is solid. In this embodiment, the compartment 34 may still be manufactured using a form of injection molding, but the process may be slightly more complicated, requiring the use of side action molds, to create the covering portion 98. Alternatively, the compartment 34 may be manufactured by creating two separate pieces that can be later joined. For example, the portion 92 (including the trigger 90, hinge 94, struts 96, and portion 98) may be manufactured separately from the remainder of the compartment 34 and then later joined by welding, or other processes known to those skilled in the art.

Figure 10:
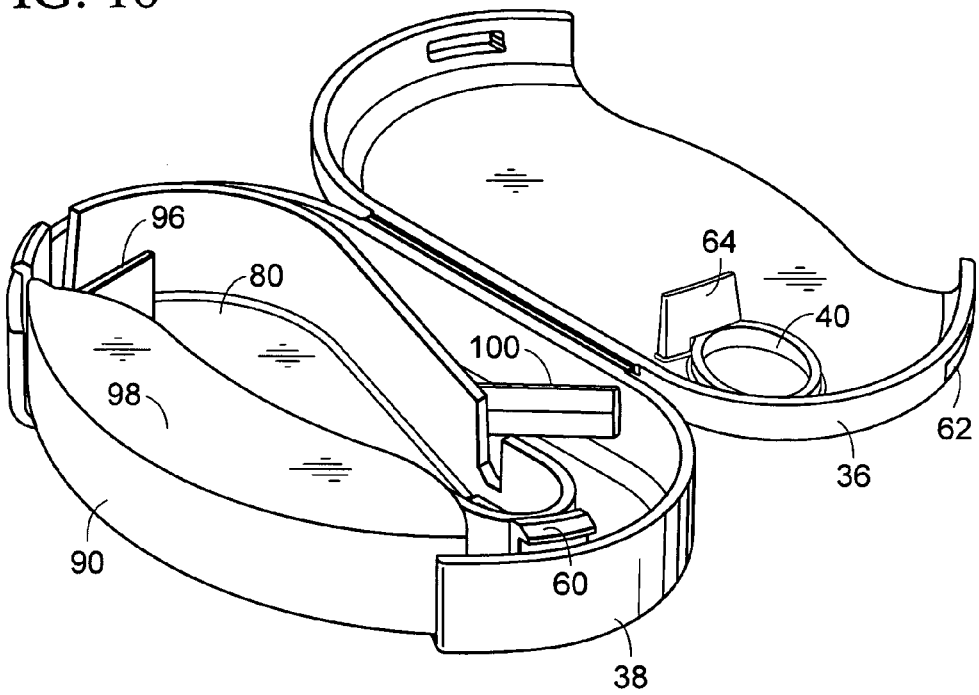
FIG. 10 is an isometric view of the tablet dispenser depicting a compartment positioned within a portion of the open housing.
Figure 11:
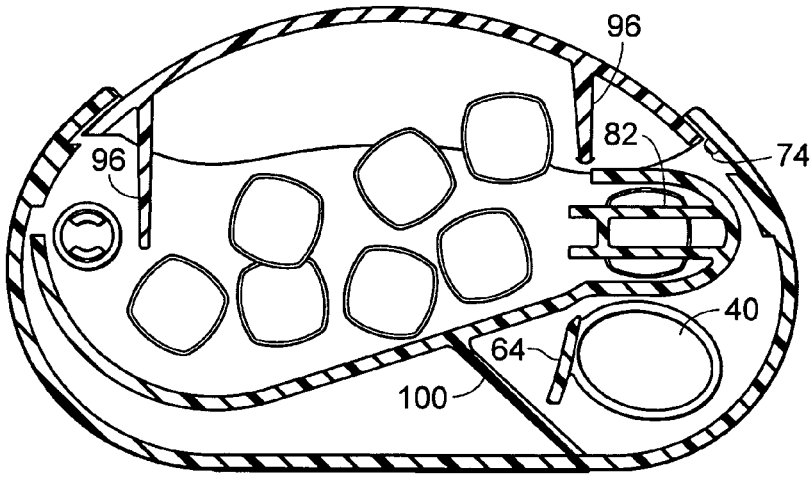
FIG. 11 is a cross-sectional view taken along the plane 11-11 in FIG. 2.

Once the components 32 and 34 have been molded or otherwise manufactured, the components 32 and 34 can be assembled to form the completed dispenser 30. Specifically, the housing 32 should be placed in the open position as illustrated in FIG. 5, while the compartment 34, depending upon the embodiment, may be pivoted from the molding orientation, as illustrated in FIGS. 6-7, to the operating orientation, as illustrated in FIGS. 8-9. The compartment 34 may then be placed into the housing 32, as illustrated in FIG. 10. After the compartment 34 is placed in the housing 32, with the pivot protrusion 70 extending into the pivot opening 102, the housing 32 may be closed. Specifically, with the embodiments shown in the figures, the upper portion 36 of the housing 32 is pivoted about the hinge 58 to the closed position wherein the snap fit engaging members 60 are received within the receiving ports 62.

It should be understood that although illustrated the embodiments of the housing 32 include the housing hinge 58, the housing 32 may alternatively be constructed without the hinge 58 as a two piece structure or other similar structure understood by those skilled in the art. Additionally, although the illustrated embodiments of the housing 32 shown include the snap fit engaging members 60 and the receiving ports 62, it should be understood that other suitable means of retaining the housing 32 in the closed configuration are acceptable as understood by those skilled in the art.

While not an element of the present invention, the tablets 42 may be inserted at any or all of a variety of times during the manufacturing and assembly of the dispenser 30, as understood by those skilled in the art. For example, the tablets 42 may be inserted into the compartment 34 prior to or after assembly into the housing 32. Similarly, the tablets 42 may be inserted into the compartment 34 when the compartment 34 is in the initial, as-molded configuration (FIGS. 6 and 7) prior to moving the compartment into the operating configuration.

Figure 2:
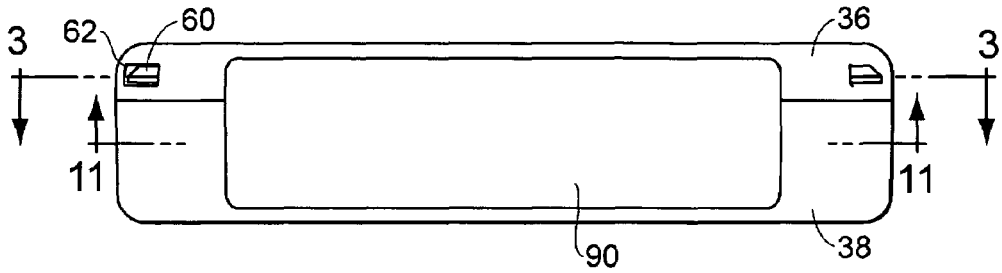
FIG. 2 is a side view of the tablet dispenser of FIG. 1.

The operation of the dispenser 30 will now be discussed in detail with regard to dispensing tablets 42 from the dispenser 30. Once the tablets 42 have been inserted into the dispenser 30 and the dispenser 30 has been closed, as shown in FIG. 1, the tablets 42 may be dispensed. Specifically, the dispenser compartment 34 is generally in a non-dispensing position, as illustrated in FIGS. 1A and 3, as the biasing member 100 biases the compartment 34 to this position. When a user desires to dispense one or more tablets 42, the user may first need to tip and/or shake the dispenser 30 in an orientation with the dispensing orifice 40 located generally below the trigger pivot axis (axis 50 in FIG. 3A) so that at least one tablet 42 slides from the storage region 44 onto the platform 82 (FIG. 3A). Then, the user applies force to the trigger 90 to rotate the compartment 34 about the axis 50 to the dispensing position, as shown in FIG. 1B. As viewed from above, the tablet 42 is visible through the dispensing orifice 40 in FIG. 1B. To fully dispense the tablet 42 through the orifice 40, the dispenser 30 may be rotated or turned such that gravity will assist the tablet 42 to dispense through the orifice 40 as the compartment 34 is in the dispensing position. The tablet(s) 42 will dispense generally parallel to the axis 50. It should be understood that typically, no tablets 42 will be dispensed while the compartment 34 is in the non-dispensing position (FIGS. 1 and 2).

As seen in FIGS. 3A and 4A, at least some of the tablets 42 are located in the storage region 44 along the plane A, while the tablet 42 to be dispensed in the tablet transport region 46 is located along a plane B, which is substantially parallel to plane A. As plane B is elevated with respect to plane A, the dispenser 30 must be tipped, rotated, turned, or shaken to allow gravity to move one or more of the tablets 42 along the ramp 84 to the tablet transport platform 82.

Additionally, the blocking tab 64 prevents additional tablets 42 from entering the tablet transport platform 82 while the compartment 34 is in the dispensing position. When the compartment 34 is pivoted to the dispensing position (compare FIG. 3 with FIG. 4), the blocking tab 64 enters the slot 88 and prevents additional tablets 42 from contacting the tablet transport platform 82. For a given size tablet 42, the size of the platform 82 extending beyond the blocking tab 64 toward the orifice 40 can be designed to accept only one tablet 42, or two tablets 42, or any other desired multiple of tablets 42 to be dispensed with one actuation of the dispenser 30. After the tablet(s) 42 are discharged from the dispenser 30, the user releases the trigger 90 to allow the compartment 34 to pivot back to the non-dispensing position where the compartment 34 is spaced away from the blocking tab 64 thereby allowing another tablet to occupy the tablet transport platform 82.

As described above, the dispenser 30 includes the biasing member 100 to bias the compartment 34 to the non-dispensing position with a biasing force, which may or may not be linear. The biasing member 100 biases the compartment 34 in this manner to provide resistance against accidental dispensing of tablets 42. While the biasing member 100 may not prevent all accidental dispensing, it may resist accidental dispensing, for example, when the dispenser 30 is located in a user's pocket or purse.

As described above, the dispenser 30 includes a rib 74 that may be located in a variety of positions. The rib 74 has a variety of purposes. For example, the rib 74 may be designed to provide a minimum resistance to prevent accidental pivoting of the compartment 34 to the dispensing position. The rib 74 may be designed such that a minimum activating force on the trigger 90 is required to move part of the compartment 34 against and past the rib 74 as the compartment 34 pivots to the dispensing position. Therefore, both the rib 74 and the biasing member 100 may serve to resist accidental dispensing of tablets 42 from the dispenser 30.

The rib 74 may be designed to cause the dispenser to emit an audible click-type sound when part of the compartment 34 engages, and then passes beyond, the rib 74. The click-type sound may serve to inform the user that the trigger 90 has been pressed, either intentionally or accidentally. Depending upon the location of the rib 74, the trigger 90, the biasing member 100 or other structure of the dispenser may be creating the click-type sound.

As described above, the rib 74 may be located in a variety of positions and orientations on the dispenser 30. For example, in the embodiment shown in FIGS. 1-12, the rib 74 is located along the sidewall 56 of the housing. In this embodiment, a leading edge portion of the trigger 90 contacts the rib 74 (see FIG. 11) as the trigger 90 is pressed. As the trigger 90 is pressed, and the activation force overcome, the trigger 90 and/or the rib 74 will deform and make the click-type sound. The user can continue to press the trigger 90 to cause the compartment 34 to pivot all the way to the dispensing position, assuming the trigger 90 is being pressed with sufficient force to overcome the force of the biasing member 100.

Additionally, the rib 74 in this embodiment may be shaped to permit the trigger 90 to easily pass back over the rib 74 when pivoting from the dispensing position to the non-dispensing position. The rib 74 may be designed such that the rib 74 may be overcome in this fashion by the force from the biasing member 100 biasing the compartment 34 back to the non-dispensing position.

The rib 74 may also be located on the floor 52 of the housing 32, as illustrated in FIGS. 13-14. In this embodiment, a bottom portion of the trigger 90 contacts the rib 74. As the trigger 90 is pressed, the bottom portion of the trigger 90 contacts the front side 76 of the rib 74, which resists pivoting of the compartment 34. Once the activation force has been overcome, the bottom portion of the trigger 90 and/or the ramp 74 will deform and make the click-type sound similar to the embodiment described above. The user can continue to press the trigger 90 to cause the compartment 34 to pivot all the way to the dispensing position, assuming the trigger 90 is being pressed with sufficient force to overcome the force of the biasing member 100. Additionally, the rib 74 in this embodiment may be shaped to permit the trigger 90 to easily pass back over the rib 74 when pivoting from the dispensing position to the non-dispensing position. For example, the back side 78 of the ramp 74 is shaped with a generally gradual angle so as to allow the trigger 90 to pass easily over the back side 78 of the rib. The rib 74 may be designed such that the rib 74 may be overcome in this fashion by the force from the biasing member 100.

Figure 18:
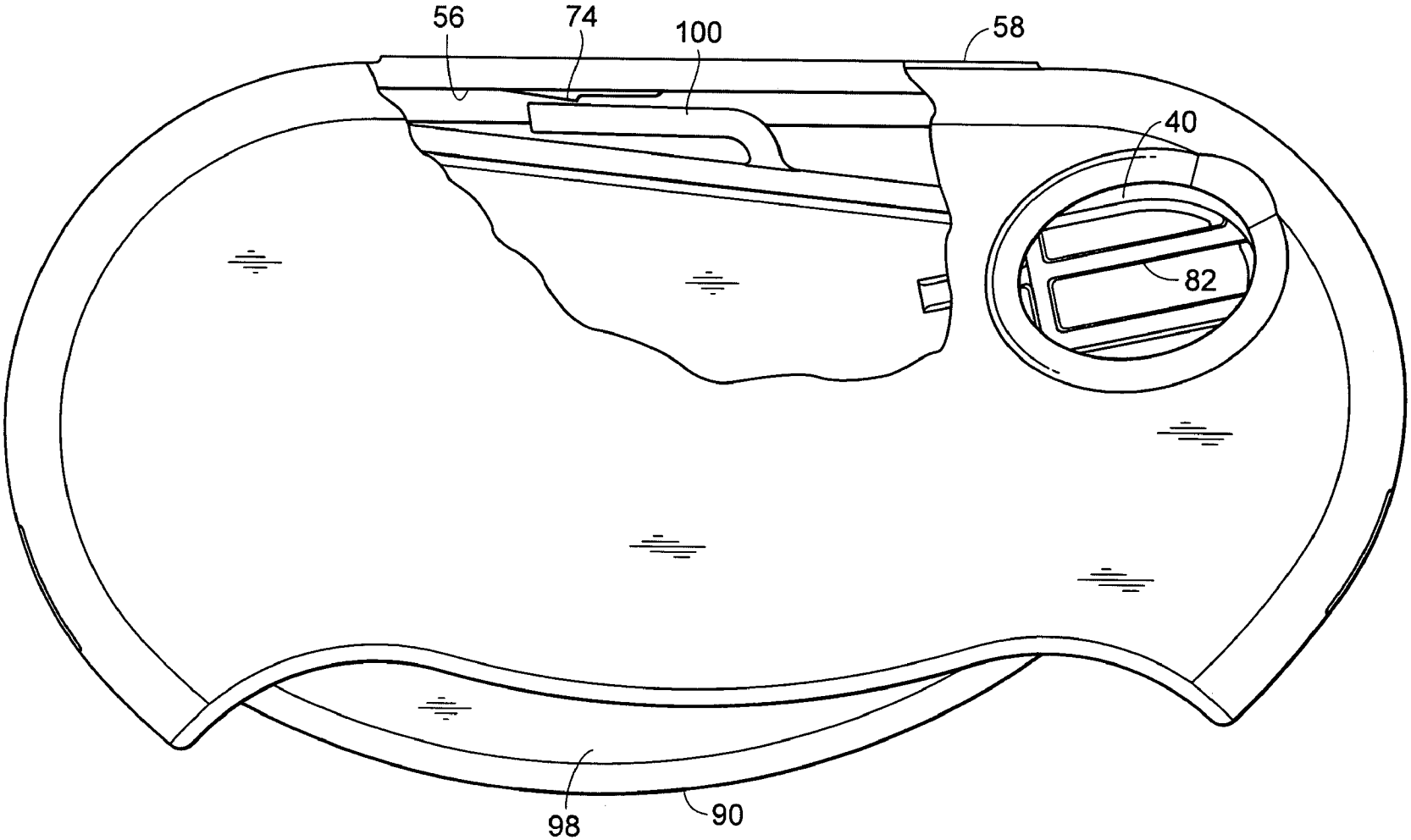
FIG. 18 is a partial cut-away top view of the tablet dispenser of FIG. 16 in a dispensing configuration.

Yet another embodiment is illustrated in FIGS. 16-18. In this embodiment, the rib 74 is again located on the sidewall 56, but is located in a different position on the sidewall 56 compared to the first embodiment. Additionally, this embodiment differs from the previously described embodiments in that the rib 74 contacts the biasing member 100 instead of a portion of the trigger 90. Similar to the previous embodiment, the rib 74 has a front face 76 having a sharp angle to resist the biasing member from easily passing over the rib 74 when the compartment 34 is pivoted towards the dispensing position. To pass over the front face 76, the compartment 34 must be pressed with a sufficient activation force to overcome the resistance force. Once the resistance force is overcome, the biasing member 100 will move past the rib 74. Again, the compartment 34 will continue to pivot to the dispensing position as long as sufficient force to overcome the biasing force is being applied. As in the previously described embodiments, the compartment 34 will pivot back to the non-dispensing position when the user releases the trigger 90, and the biasing member 100 passes along the gradually angled back side 78 of the rib 74.

As the above embodiments illustrate, the rib 74 may be located in a variety or locations having a variety of orientations. The actual placement of the rib 74 may be adjusted as required by the specific design. Additionally, the location of the rib 74 may be adjusted for manufacturing and/or assembly purposes. The design and placement of the rib 74 should be easily understood by those skilled in the art as being easily adjusted for the specific application. In some applications, it may be desirable to entirely omit such a rib 74, and to rely solely on the biasing force of the biasing member 100 to prevent, or at least resist or inhibit, accidental actuation.

It will be readily apparent from the foregoing detailed description of the invention and from the illustrations thereof that numerous variations and modifications may be effected without departing from the true spirit and scope of the novel concepts or principles of this invention.

What is claimed is:

1. A dispenser for tablets comprising:

a housing; and a compartment that is pivotable about a pivot axis and that is located at least partially within the housing, the compartment comprising a molded unitary structure including a tablet storage base for initially storing all of the tablets, and wherein at least some of the stored tablets are stored in a first plane, and said compartment including a tablet transport platform for supporting a single tablet for movement in a second plane parallel to the first plane, the tablet storage base being unitary with the tablet transport platform whereby pivoting movement of the compartment causes the single tablet transport platform to carry said single tablet to a dispensing position.

2. The dispenser of claim 1 further comprising a biasing member to bias the compartment toward a non-dispensing position and a blocking tab to prevent more than a predetermined number of tablets from entering the tablet transport platform.

3. The dispenser of claim 2 wherein the biasing member is a tablet spring attached to the compartment; and the housing includes a rib to engage a portion of the spring as the compartment is pivoted through just a portion of the range of pivoting motion so as to temporarily increase the resistance as the spring elastically deforms temporarily and the rib subsequently disengages upon increased angular displacement of the compartment.

4. The dispenser of claim 1 wherein the compartment further includes a ramp connecting a tablet storage region with the tablet transport platform.

5. The dispenser of claim 1 wherein the compartment includes a trigger having at least one of a lower edge and a side edge; and either the housing or the compartment includes a rib to engage a portion of the other one of the housing and compartment as said compartment is pivoted through just a portion of the range of pivoting motion so as to temporarily increase the resistance as either or both of the housing and compartment elastically deform temporarily and said rib subsequently disengages upon increased angular displacement of said compartment.

6. The dispenser of claim 5 wherein the housing includes a floor and a side wall extending substantially perpendicularly from the floor, and wherein the rib is located on the side wall for engaging the side edge of the trigger.

7. The dispenser of claim 5 wherein the rib is located on a floor of the housing to engage the lower edge of the trigger and includes (1) an angled portion to temporarily increase the resistance force as the compartment pivots to a dispensing position, and (2) a gradual sloped portion to permit the compartment to pass over the rib as the compartment pivots to a non-dispensing position.

8. The dispenser of claim 1 in which said housing has a lower portion and an unper portion; and further including snap-fit engaging members to fixedly hold the upper portion to the lower portion and wherein the upper portion is pivotably attached to the lower portion by a hinge.

9. The dispenser of claim 1 wherein:

said housing has a floor and a ceiling;

said compartment has a base disposed generally above, and parallel to, said housing floor; and at least part of said compartment is open above at least a portion of said compartment base but is occluded by said housing ceiling.

10. A method for manufacturinn a tablet dispenser comprisinn the steps of:

molding a housing as a unitary structure having an upper portion and a lower portion, the upper portion pivotably attached to the lower portion by a hinge;

molding a compartment for storaae of tablets;

inserting the compartment within the housing; and pivoting one of the housing portions relative to the other housing portion to substantially enclose the compartment within the housing;

wherein the step of molding a compartment includes molding a main body portion pivotably attached to an extended portion by a hinge.

11. The method of claim 10 wherein one of the compartment portions is pivoted relative to the other portion prior to inserting the compartment within the housing.

* * * * *